US005756991A

United States Patent [19]

Risinger et al.

[11] Patent Number: 5,756,991

[45] Date of Patent: May 26, 1998

[54] EMISSIVITY TARGET HAVING A RESISTIVE THIN FILM HEATER

[75] Inventors: Bradley R. Risinger, Ellicott City, Md.; Richard A. James, Long Beach, Calif.

[73] Assignee: Raytheon Company, Lexington, Mass.

[21] Appl. No.: 696,760

[22] Filed: Aug. 14, 1996

[51] Int. Cl.[6] ..... G12B 13/00

[52] U.S. Cl. ..... 250/252.1; 250/504 R

[58] Field of Search ..... 250/252.1 A, 504 R

[56] References Cited

U.S. PATENT DOCUMENTS

| | | | |
|---|---|---|---|
| 4,387,301 | 6/1983 | Wirick et al. . | |
| 4,480,372 | 11/1984 | Wirick et al. . | |
| 5,036,206 | 7/1991 | Frank . | |
| 5,083,034 | 1/1992 | Frank et al. . | |
| 5,265,958 | 11/1993 | Ludlow | 374/2 |
| 5,324,937 | 6/1994 | Chen et al. . | |
| 5,416,332 | 5/1995 | Chen et al. . | |
| 5,600,148 | 2/1997 | Cole et al. | 250/495.1 |

OTHER PUBLICATIONS

"Electro–Optic Test Collimators in Real World Systems" by R. James and B. Risinger, Hughes Aircraft Co., System Readiness, Test Technology for the 21st Century, Autotestcon 95 Proceedings, Atlanta, GA Aug. 3–10, 1995, pp. 321–327.

"Smart E–O Targets as Versatile, Self–Contained Instruments" by Kenn Bates, Hughes Technical Services Company, System Readiness, Test Technology for the 21st Century , Autotestcon 95 Proceedings, Atlanta, GA Aug. 3–10, 1995, pp. 328–332.

*Primary Examiner*—Constantine Hannaher

*Attorney, Agent, or Firm*—W. C. Schubert; G. H. Lenzen, Jr.

[57] ABSTRACT

An electro-optical target and test apparatus having an improved resistive heating element. The resistive heating element comprises a resistive thin film coating layer, such as an indium tin oxide resistive coating layer, a resistive thin film semiconductor coating layer, or an electrically resistive polymer layer, that is disposed on a back side of a substrate. The substrate has a target pattern disposed on its front surface that to provide an emissivity target. The resistive coating layer provides a means for heating the substrate which produces a uniform source of thermal radiation because it has no holes therein. The resistive heating element is heated to radiate at a controlled target temperature set by a temperature controller coupled thereto. The materials comprising the coating layer and substrate may be transparent to visible and near infrared radiation. This allows radiation from visible and near infrared components of the system under test to pass through the substrate and resistive heating element to detector(s) located behind the heating element without requiring holes in the emissivity target. Also, use of a transparent substrate and heating element allows the use of visible and/or infrared light sources disposed behind the heating element, and thus the electro-optical target can simultaneously radiate both visible and infrared radiation at the system under test.

10 Claims, 1 Drawing Sheet

EMISSIVITY TARGET HAVING A RESISTIVE THIN FILM HEATER

BACKGROUND

The present invention relates generally to electro-optical targets, and more particularly, to electro-optical emissivity targets having resistive thin film heaters.

The assignee of the present invention designs and manufactures electro-optical test equipment for testing military fire control systems, and the like. Such electro-optical test equipment includes an electro-optical emissivity target that is imaged by components of electro-optical systems that are tested.

Heretofore, the electro-optical target comprised a glass substrate, a specially made Kapton heater pad or strip, and a molybdenum plate. The molybdenum plate was disposed between the Kapton heater pad or strip and the glass substrate. The Kapton heater pad provided to achieve uniform heating of the glass substrate The Kapton heater pad was attached by adhesive or otherwise bonded to the molybdenum plate, which was in turn bonded to the glass plate. The Kapton heater strip had resistive wire patterns in it, with holes provided as necessary for calibration sources disposed in front of the target, and detectors disposed behind the target. The molybdenum plate also had holes disposed through it for these devices. The temperature of the molybdenum plate was monitored by a platinum resistance thermometer or thermocouple to estimate the temperature of the glass substrate, and hence the target, and holes through the Kapton heater strip and molybdenum plate were also required to connect to the platinum resistance thermometer or thermocouple. However, this arrangement provided for an electro-optical target that exhibited non-uniform heating in the vicinity of the holes for the sources and detectors.

A number of U.S. Patents disclose or use emissivity targets. These patents include U.S. Pat. No. 5,416,322 entitled "Integrated Test Target Assembly and Compact Collimator", U.S. Pat. No. 5,324,937 entitled "Target for Calibrating and Testing Infrared Devices", U.S. Pat. No. 5,036,206 entitled "Combined Laser Position Detector, Infrared Emissivity Target and TV Target", U.S. Pat. No. 5,083,034 entitled "Multi-Wavelength target System", U.S. Pat. No. 4,387,301 entitled "Target for Calibrating and Testing Infrared Detection Devices", and U.S. Pat. No. 4,480,372 entitled "Process of Fabricating Target for Calibrating and Testing Infrared Detection Devices", all of which are assigned to the assignee of the present invention. Two papers that generally relate to the present invention entitled "Smart E-O Targets as Versatile, Self-Contained Instruments", and "Electro-Optic Test Collimators in Real World Systems" were presented at the 1995 Autotestcon symposium in Atlanta, Ga., Aug. 3–10, 1995 and were published in its Proceedings. These papers, however, provided no teaching regarding the improved emissivity targets employing resistive thin film heaters of the present invention.

Accordingly, it is an objective of the present invention to provide for improved electro-optical emissivity targets having improved heating elements.

SUMMARY OF THE INVENTION

To meet the above and other objectives, the present invention comprises electro-optical emissivity targets having improved heating elements. In a first embodiment of the present invention, the electro-optical emissivity target comprises a substrate, which may be glass, that has a coating layer comprising a target pattern, disposed on a front surface thereof. Typically the target pattern is in the form of a bar target pattern, but other shapes may be used. The substrate with its target pattern forms an emissivity target. The emissivity target provides a radiation source that radiates infrared radiation that is used to test infrared sensors, for example. The emissivity target is heated using a heating element that is disposed on a back or rear surface of the substrate.

The heating element comprises a resistive thin film heater that may be a coating layer, such as an indium tin oxide resistive coating layer, or other oxide coating layer, for example, that is deposited onto a back side of the substrate. The resistive thin film heater may also be a thin film semiconductor coating that is preferably transparent and resistive. In addition, the resistive thin film heater may also be an electrically resistive polymer that may be formed in the manner of an adhesive decal that is adhered or otherwise affixed to the back surface of the substrate.

The substrate may be transparent or nontransparent depending upon the application for which the emissivity target is used. Use of a transparent substrate and heating element, for example, allows the use of a visible and/or infrared light source disposed behind the heating element which permits transmission of visible or infrared radiation. Using this arrangement, the emissivity target can simultaneously radiate both visible and infrared wavelengths of radiation and thus permits testing of both infrared and visible sensors, such as are found in many military electro-optical systems.

The indium tin oxide coating layer, for example, provides a means for heating the substrate, and which provides a uniform source of thermal radiation because it has no holes therein. The emissivity target (substrate) is heated by the heating element (indium tin oxide resistive coating layer) and radiates at a controlled target temperature under control of a temperature controller that is coupled to the heating element.

In a reduced to practice embodiment of the present emissivity target, the heating element was an indium tin oxide resistive coating layer that is transparent to visible and near infrared radiation. The use of such a heating element allows radiation from visible and near infrared sources to be projected through the substrate and coating layer to detectors located behind the coating layer without requiring holes therethrough. Similarly, the visible and/or infrared light source disposed behind the heating element may be used to produce visible radiation that is observable as a target pattern.

The indium tin oxide coating layer employed in the reduced to practice emissivity target provides for an improved emissivity target for a number of reasons. Use of the indium tin oxide coating layer provides more uniform heat output which results in improved temperature and radiometric calibration. Use of the indium tin oxide coating layer provide faster heating and cooling times for the target due to the reduced thermal mass and increased thermal conductance. Use of the indium tin oxide coating layer also reduces the number of parts of the emissivity target which reduces assembly time and related costs. It also reduces the weight of the emissivity target.

Similarly, the use of the other types of resistive thin film heater elements, including the polymer coating layer or thin film semiconductor coating layer also provides for similar advantages. In addition, the use of transparent substrate materials and resistive thin film heater elements permits the emissivity target to be used in multiple wavelength bands, which is not possible using conventional designs.

The present emissivity target may be used to test electro-optic systems developed by the assignee of the present invention. The present invention exhibits better uniformity across the target, and increases its calibration accuracy. The present invention also reduces the parts count by two since the molybdenum plate and Kapton heater pad are no longer necessary. The drawing count is reduced, and assembly and bonding time is reduced because the heater coating is applied directly to the back surface of the glass substrate. The heater coating reduces the weight, size, and power of the target assembly, but more importantly reduces the thermal mass of the target which increases the speed at which the target reaches temperature and cools. The combination of these features provides a less expensive, smaller, more accurate, more uniform, and faster emissivity target for use in electro-optic test equipment.

In a second embodiment of the present invention, the electro-optical emissivity target comprises a resistive heating element that is disposed on a rear surface of a metal target. The deposited or adhered resistive heating element replaces a conventional black body source that is normally disposed behind the metal target. As in the first embodiment, the resistive heating element of the second embodiment may be transparent to permit the use of the visible and/or infrared light source and detectors behind the target. The second embodiment of the emissivity target eliminates the use of the conventional black body source while providing many of the benefits of the first embodiment.

BRIEF DESCRIPTION OF THE DRAWINGS

The various features and advantages of the present invention may be more readily understood with reference to the following detailed description taken in conjunction with the accompanying drawings, wherein like reference numerals designate like structural elements, and in which.

DETAILED DESCRIPTION

Figure 1:
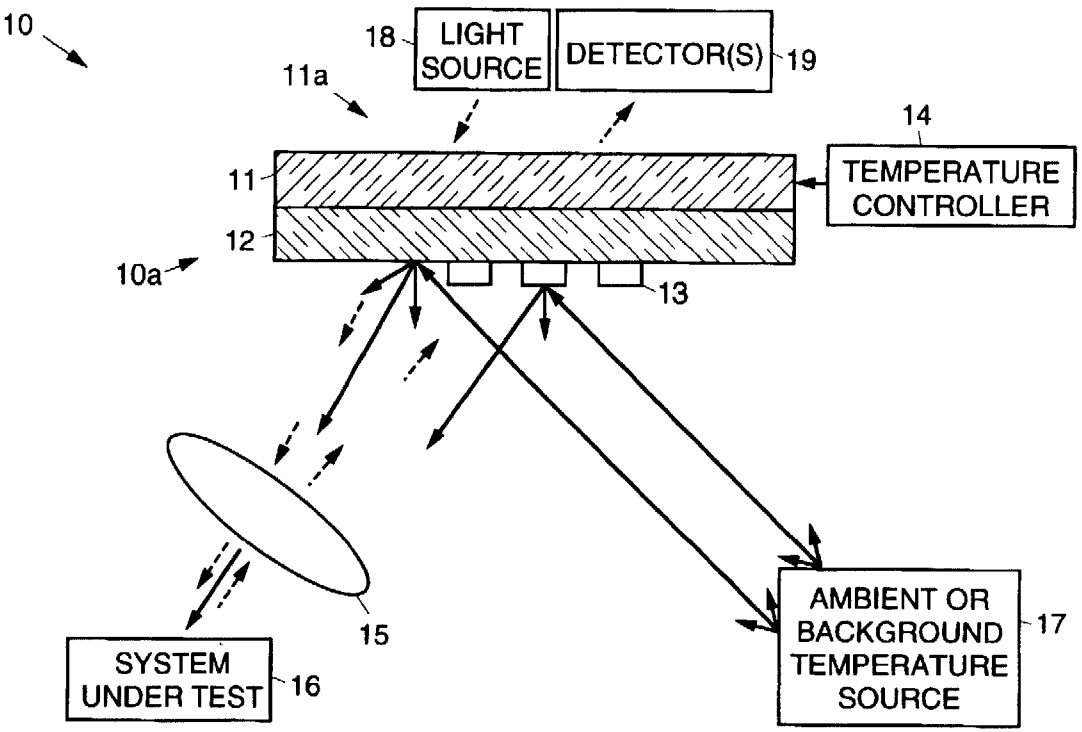
FIG. 1 illustrates electro-optical targets and test apparatus in accordance with a first embodiment of the present invention.

Referring to FIG. 1, it illustrates electro-optical targets 10 and test apparatus 10 in accordance with the principles of the present invention that has been reduced to practice. The drawing figure is not drawn to scale in order to more clearly show the components of the electro-optical target 10. The reduced to practice electro-optical target 10 incorporates a coating layer 11, such as an indium tin oxide coating layer 11, or other oxide coating layer, for example, as a resistive thin film heating element 11*a*. The electro-optical target 10 includes a heated emissivity target 10*a* including a substrate 12 or backing material 12, which may comprise glass, that has the resistive thin film heating element 11*a* disposed on a back surface thereof. In the reduced to practice electro-optical target 10, the resistive thin film heating element 11*a* comprises the indium tin oxide coating layer 11 that is deposited onto the back surface of a glass substrate 12. The indium tin oxide coating layer 11, for example, may be deposited to a thickness that is typically less than 0.001 inches, although the thickness is not critical to the performance of the electro-optical target 10.

The substrate 12 or backing material 12 has a coating pattern 13, or target pattern 13, disposed on a front surface thereof. The substrate 12 is heated by the heating element 11*a* and radiates at a controlled target temperature that is set using a temperature controller 14 coupled to the heating element 11*a*. The electro-optical target 10 also includes an ambient or controlled background source 17 that radiates energy at either ambient temperature or at a controlled background temperature.

Energy is supplied to the substrate 12 by way of the heating element 11*a* and the absorbed energy is radiated by the heated substrate 12. Also, energy provided by the ambient or controlled background source 17 is reflected by the emissivity target 10*a*. The radiated energy and the reflected energy is collimated by collimating optics 15, which may be provided by a collimating lens 15 or a collimating mirror 15. Energy that is collimated by the collimating optics 15 is directed at and imaged by a system under test 16, such as a forward looking infrared system 16 or other electro-optical system 16. The system under test 16 may be calibrated and/or tested in a conventional manner using the electro-optical target 10.

It is to be understood that other materials may be used as the coating layer 11 or resistive thin film heating element 11*a*. The resistive thin film heating element 11*a* may be a thin film semiconductor coating that is preferably transparent and resistive. In addition, the resistive thin film heating element 11*a* may also be an electrically conductive (resistive) polymer that may be formed in the manner of an adhesive decal that is adhered or otherwise affixed to the back surface of the substrate 12. Again, the thin film semiconductor coating or polymer used as the resistive thin film heating element 11*a* is preferably transparent, although this is not required. This is explained below.

The substrate 12 may be transparent or nontransparent depending upon the application for which the emissivity target 10*a* or electro-optical target 10 is used. Use of a transparent substrate 12 and heating element 11*a*, for example, allows the use of a visible and/or infrared light source 18 disposed behind the heating element 11*a* which permits transmission of visible and infrared radiation. Thus, using the transparent heating element 11*a*, substrate 12 and visible and/or infrared light source 18, the electro-optical target 10 can simultaneously radiate both visible and infrared wavelengths of radiation. This permits testing of both infrared and visible sensors comprising a system under test 16, such as are found in military electro-optical systems, for example. In addition, the use of the transparent substrate 12 and heating element 11*a* allows certain systems under test 16 that contain visible lasers or other light sources, for example, to irradiate one or more detectors 19 positioned in back of the emissivity target 10*a*. Radiation of energy from the visible laser or visible or infrared light sources may be projected through the substrate 12 and coating layer 11 or heating element 11*a* and onto the detector(s) 19 which may be used to test the system under test 16.

The indium tin oxide coating layer 11 or other resistive thin film heating element 11*a* thus provides a means for heating the substrate 12 so that it provides a uniform source of thermal radiation. The substrate 12 is heated by the resistive thin film heating element 11*a*, such as the indium tin oxide resistive coating layer 11, for example, and radiates at a controlled target temperature set by the temperature controller 14. The use of a transparent resistive coating layer 11 and substrate 12 that is transparent to visible and near infrared radiation allows radiation from visible and near infrared components of the system under test 16 to be projected through the substrate 12 and resistive thin film heating element 11*a* to the detector(s) 19 located behind the heating element 11*a* without requiring holes in the emissivity target 10*a*.

Use of the indium tin oxide coating layer 11, polymer coating layer 11, or thin film semiconductor layer 11, provides for an improved emissivity target 10. The emissivity target 10 has more uniform heat output which results in improved temperature and radiometric calibration. The emissivity target 10 has faster heating and cooling times due to the reduced thermal mass and increased thermal conductance derived from using the types coating layers 11 employed as the heating element 11*a*. The emissivity target 10 also has a reduced number of parts which reduces assembly time and related costs, and reduces its weight.

Figure 2:
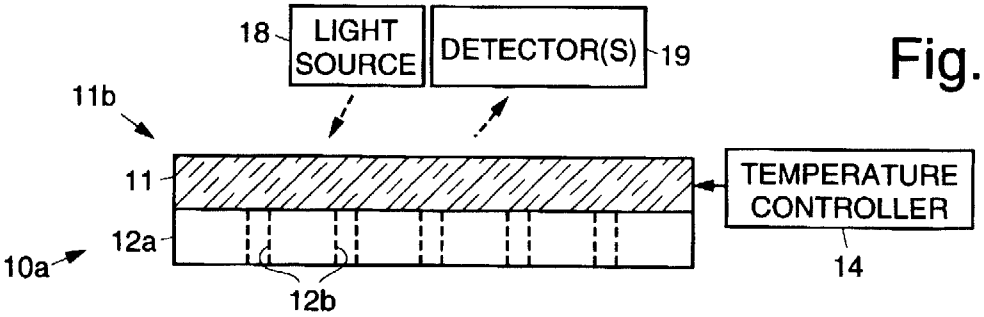
FIG. 2 illustrates a second embodiment of the present electro-optical target and test apparatus.

Referring now to FIG. 2, it illustrates a second embodiment of an electro-optical target 10 and test apparatus 10 in accordance with the present invention. In the second embodiment, the electro-optical emissivity target 10 comprises a resistive heating element 11*a* that is disposed on a rear surface of a metal target 12*a*. The metal target 12*a* has a plurality of slots 12*b* or openings 12*b* disposed therein that create the target pattern. The deposited or adhered resistive heating element 11*a* replaces a conventional black body source (not shown) that is normally disposed behind the metal target 12*a*. The resistive heating element 11*a* may be transparent to permit the use of the visible and/or infrared light source 18 and detector(s) 19 behind the target 10. The second embodiment of the emissivity target 10 thus eliminates the use of the conventional black body source while providing many of the benefits of the first embodiment.

Thus, improved electro-optical emissivity targets have been disclosed. It is to be understood that the described embodiments are merely illustrative of some of the many specific embodiments which represent applications of the principles of the present invention. Clearly, numerous and other arrangements can be readily devised by those skilled in the art without departing from the scope of the invention.

What is claimed is:

1. An electro-optical emissivity target comprising:

a substrate having a predetermined target pattern disposed on a front surface thereof; and a heatable resistive coating layer disposed on a rear surface of the substrate wherein the coating layer comprises an indium tin oxide coating layer.

2. An electro-optical emissivity target comprising:

a substrate having a predetermined target pattern disposed on a front surface thereof; and a heatable resistive coating layer disposed on a rear surface of the substrate wherein the coating layer comprises a resistive thin film semiconductor coating layer.

3. An electro-optical emissivity target comprising:

a substrate having a predetermined target pattern disposed on a front surface thereof; and a heatable resistive coating layer disposed on a rear surface of the substrate wherein the coating layer comprises a transparent resistive thin film semiconductor coating layer.

4. An electro-optical emissivity target comprising:

a substrate having a predetermined target pattern disposed on a front surface thereof; and a heatable resistive coating layer disposed on a rear surface of the substrate, further comprising a light source and a detector disposed in back of the coating layer that is used to radiate and detect radiation in predetermined wavelength bands, respectively.

5. An electro-optical emissivity target comprising:

a substrate having a predetermined target pattern disposed on a front surface thereof wherein the substrate comprises glass; and a heatable resistive coating layer disposed on a rear surface of the substrate.

6. Test apparatus for use in testing a system under test, said apparatus comprising:

an emissivity target comprising:

a substrate having a predetermined target pattern disposed on a front surface thereof; and a heatable resistive coating layer disposed on a rear surface of the substrate wherein the coating layer comprises an indium tin oxide coating layer;

a temperature controller coupled to the resistive coating layer for controlling its temperature; and collimating optics for collimating energy emitted by and reflected from the emissivity target and for directing the collimated energy at the system under test.

7. Test apparatus for use in testing a system under test, said apparatus comprising:

an emissivity target comprising:

a substrate having a predetermined target pattern disposed on a front surface thereof; and a heatable resistive coating layer disposed on a rear surface of the substrate wherein the coating layer comprises a resistive thin film semiconductor coating layer;

a temperature controller coupled to the resistive coating layer for contrlling its temperature; and collimating optics for collimating energy emitted by and reflected from the emissivity target and for directing the collimated energy at the system under test.

8. Test apparatus for use in testing a system under test, said apparatus comprising:

an emissivity target comprising:

a substrate having a predetermined target pattern disposed on a front surface thereof; and a heatable resistive coating layer disposed on a rear surface of the substrate wherein the resistive coating layer is transparent;

a temperature controller coupled to the resistive coating layer for controlling its temperature; and collimating optics for collimating energy emitted by and reflected from the emissivity target and for directing the collimated energy at the system under test.

9. Test apparatus for use in testing a system under test, said apparatus comprising:

an emissivity target comprising:

a substrate having a predetermined target pattern disposed on a front surface thereof; and a heatable resistive coating layer disposed on a rear surface of the substrate wherein the resistive coating layer is transparent;

a temperature controller coupled to the resistive coating layer for controlling its temperature; and collimating optics for collimating energy emitted by and reflected from the emissivity target and for directing the collimated energy at the system under test further comprising:

a light source disposed adjacent a rear surface of the coating layer for irradiating the system under test with radiation at predetermined wavelengths; and a detector disposed adjacent the rear surface of the coating layer for detecting radiation at predetermined wavelengths derived from the system under test.

10. Test apparatus for use in testing a system under test, said apparatus comprising:

an emissivity target comprising:

a substrate having a predetermined target pattern disposed on a front surface thereof; and a heatable resistive coating layer disposed on a rear surface of the substrate wherein the substrate comprises glass;

a temperature controller coupled to the resistive coating layer for controlling its temperature; and collimating optics for collimating energy emitted by and reflected from the emissivity target and for directing the collimated energy at the system under test.

* * * * *